United States Patent [19]

Smith

[11] 4,320,697

[45] Mar. 23, 1982

[54] CHIMNEY VENTILATING CAP

[75] Inventor: J. Guy Smith, Drummondville, Canada

[73] Assignee: Venmar, Inc., Germanville, Canada

[21] Appl. No.: 165,086

[22] Filed: Jul. 1, 1980

[51] Int. Cl.[3] ..... F23L 17/10

[52] U.S. Cl. ..... 98/68; 98/70

[58] Field of Search ..... 98/68, 70, 71

[56] References Cited

U.S. PATENT DOCUMENTS

| | | | |
|---|---|---|---|
| 1,309,037 | 7/1919 | Lichty et al. | 98/68 |
| 1,407,179 | 2/1922 | Tidwell | 98/68 |
| 1,886,605 | 11/1932 | Thomas | 98/68 |
| 2,163,197 | 6/1939 | Fitzgerald | 98/68 |
| 2,310,828 | 2/1943 | Back | 98/70 |
| 2,823,599 | 2/1958 | Still | 98/68 |

FOREIGN PATENT DOCUMENTS

| | | | |
|---|---|---|---|
| 210570 | 3/1908 | Fed. Rep. of Germany | 98/71 |

*Primary Examiner*—Albert J. Makay
*Assistant Examiner*—Harold Joyce
*Attorney, Agent, or Firm*—Guy J. Houle

[57] ABSTRACT

A chimney ventilating cap for the evacuation of combustion gas from chimneys. The cap comprises a spherical hollow dome body defined by a forward and a rear partly semi-spherical body portion. The front and rear body portions are secured together in a spaced-apart manner to define an opening between their circumferential edges. A shield is associated with the opening. A wind governor is secured to the rear body portion. The hollow dome body has a vertical pivot connection secured to an open-ended attachment base whereby the dome body is pivotal on the vertical pivot to rotate on the base by change in wind direction.

10 Claims, 2 Drawing Figures

CHIMNEY VENTILATING CAP

BACKGROUND OF INVENTION

1. Field of Invention

The present invention relates to a chimney ventilating cap, and more particularly to an improved ventilating cap construction to provide a regulated suction in the chimney for the evacuation of combustible products.

2. Description of Prior Art

Because building requirements nowadays are less stringent as to chimney height and also because of varying heights of buildings in clusters, the chimneys do not properly function to evacuate combustible products as they do not provide sufficient suction. This insufficient suction causes excessive smoke to flow into the apartments of the structure rather than through the chimney, provide for imcomplete combustion of the material being burned and thereby releasing a smoke having a high content of carbon monoxide.

SUMMARY OF INVENTION

It is a feature of the present invention to provide a chimney ventilating cap which substantially overcomes the above-mentioned disadvantages, and which induces a suction at the opening of the chimney to provide a sufficient extraction force to draw the combustion gases out of the chimney.

Another feature of the present invention is to provide a chimney ventilating cap which can dampen the effects of strong winds to provide a better regulated suction at the opening of the chimney to provide a more stable combustion of a product being burned at the bottom end of the chimney.

Another feature of the present invention is to provide a chimney ventilating cap in which the induced suction is controlled whereby unnecessary loss of heat in the heating chamber is prevented.

It is a further feature of the present invention to provide a chimney ventilating cap which is of superior design and operates better than ventilating caps of this type known in the prior art.

BRIEF DESCRIPTION OF DRAWINGS

A preferred embodiment of the present invention will now be described with reference to the example thereof illustrated by the accompanying drawings, in which.

DESCRIPTION OF PREFERRED EMBODIMENTS

Figure 1:
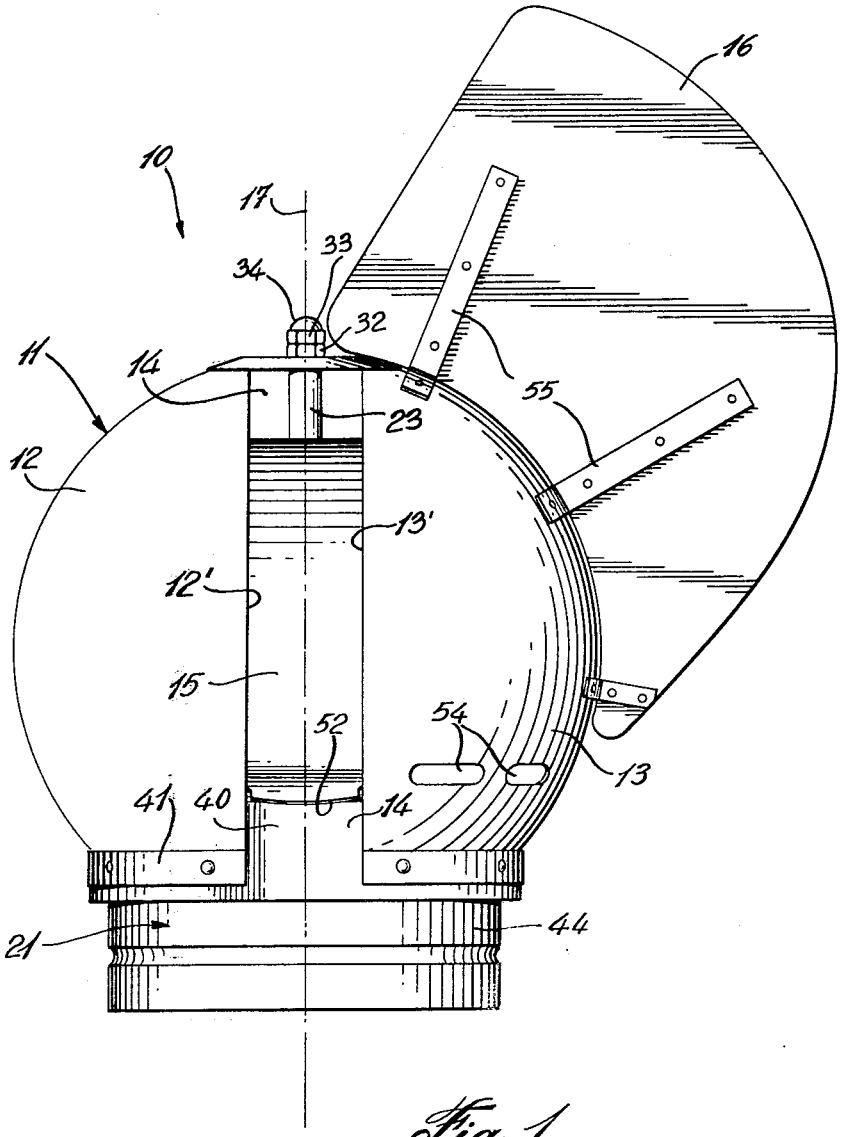
FIG. 1 is a side view of the ventilating cap of the present invention.

Referring now to the drawings, there is shown generally at 10, the chimney cap comprising a spherical hollow dome body 11 consisting of a forward and a rear, partly semi-spherical body portion 12 and 13, respectively. The front and rear body portions 12 and 13 are secured together in a spaced-apart manner to define a slot opening 14 between their circumferential edges 12' and 13'. Shield means, herein in the form of a stationary arcuate shield plate 15, is secured inwardly of the dome body 11 and spaced adjacent the opening 14.

A wind governor, herein constituted by a vertical plate 16 is secured to the rear body portion 13 to direct the forward body portion 12 against the direction of the wind to induce the maximum suction force by the wind velocity passing over the opening 14 to each side of the dome 11. The governor also positions the rear body portion 13 facing downstream of the wind direction and its semi-spherical shape prevents turbulence and thereby improves the evacuation of combustion gases flowing out of the opening 14. Thus, combustible products are quickly drawn away from the chimney cap 10. The governor plate 16 extends in a plane which passes through the central vertical axis 17 of the dome body and the foremost apex of the forward body portion 12 so that the apex portion is directed against the direction of the wind.

Figure 2:
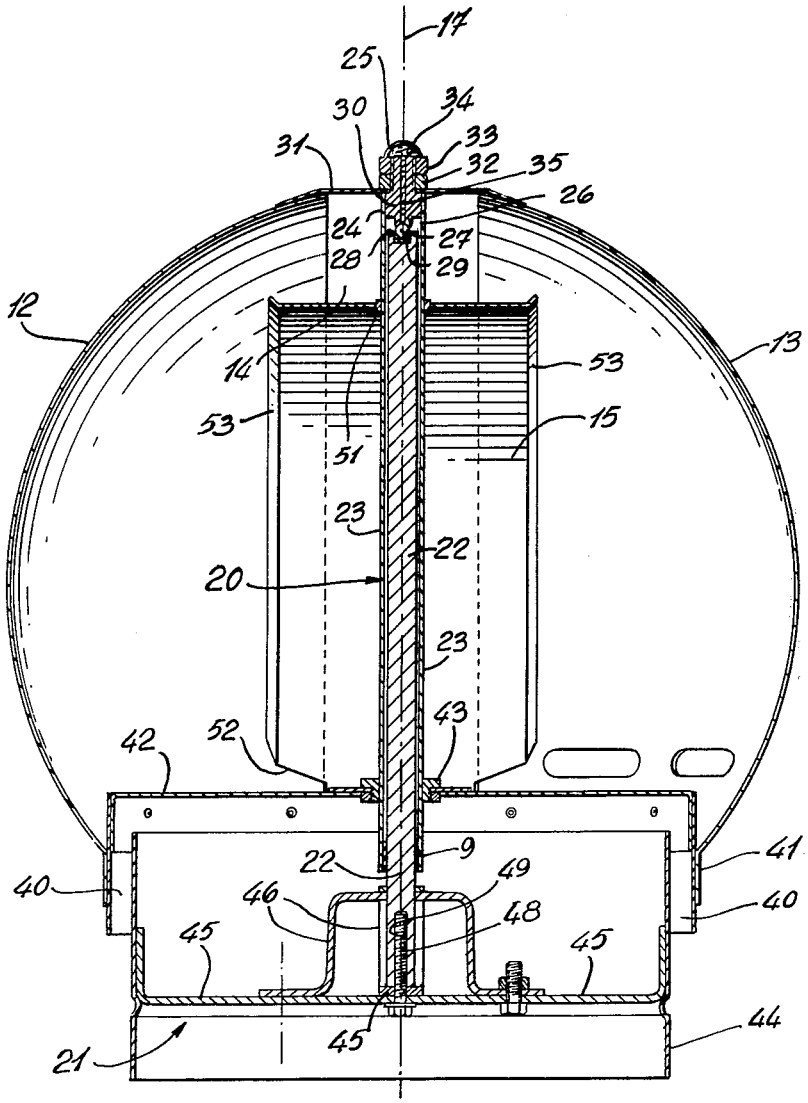
FIG. 2 is a section view through the spherical hollow dome illustrating the pivot connection and the relationship of the various elements forming the ventilating cap.

As can be seen more clearly in FIG. 2, the hollow dome body 11 is mounted on a vertical pivot 20 which is secured at a lower end to an open ended attachment base 21 whereby the dome is pivotal on the vertical pivot to rotate on the base by changes in the wind direction.

The vertical pivot connection 20 comprises a rigid straight rod 22 immovably secured at a bottom end to the attachment base 21 and in a manner which will be later described. A cylindrical sleeve 23 is retained about the rod 22 in spaced relationship thereabout. The top end 24 of the sleeve 23 is secured to a bearing element 25 which is pivotal on a top end of the rod 22.

The bearing element 25 has a lower pivot post portion 26 which has a concave lower end face to rest a ball bearing 27 therein. The top end of the rod 22 has an annular ring portion 28 with a bushing 29 therein to retain the ball bearing 27 therein. The bearing element 25 further has a shoulder portion 30 to which the upper part 24 of the cylindrical sleeve 23 connects. The portion 30 is of greater diameter than the rod 22 to maintain the sleeve 23 spaced concentrically thereabout. A bottom sleeve 9 is positioned intermediate the lower end of the sleeve and the rod to also maintain this spacing. A connecting plate 31 is secured to the top portion of the shoulder 30 and extends over a top portion of the body portions to connect thereto. The connecting plate also extends over a top portion of the slot opening 14.

The top end of the bearing element 25 is threaded to receive a lock nut 32 and a top lubricating nut 33 having a lubricating reservoir 34 therein. A lubricating channel 35 extends vertically through the bearing element 25 and communicates at a top end to the reservoir 34 and at a lower end communicates with the concave surface which is in contact with the ball bearing 27. The lubricating oil from the reservoir 34 flows down the channel 35 by gravity to lubricate the ball bearing 27.

A bottom cylindrical sleeve 40 is secured to a lower edge 41 of the body portions 12 and 13. The cylindrical sleeve 40 is maintained concentrically fixed with respect to the lower part of the sleeve 23 by support ribs 42 secured at a free end to a sleeve bushing 43 secured about a lower part of the sleeve. Thus, the body portions 12 and 13 are rigidly retained to the sleeve 23, about the pivot rod 22, from a top and bottom end portion thereof.

The attachment base 21 comprises a cylindrical connecting sleeve 44 to attach the cap 10 to a chimney (not shown). Support ribs 45 are secured inwardly across the connecting sleeve 44. In this particular embodiment there are two support ribs 45 connected transversely to one another at the center thereof. A bridge rib 46, of inverted U-shaped, is secured over the center portion of each rib 45 to stabilize the pivot rod 22 vertically. A fastening bolt 48 extends through the ribs 45 at its center intersection point and is threaded in a threaded bore 49 formed in the lower end of the pivot rod 22.

The arcuate shield plate 15 has a hole at the center apex to connect to the sleeve 23 which passes therethrough to support the shield plate 15 in its proper position. The shield plate may be welded, such as at 51, to the sleeve 23. As can be seen more clearly in FIG. 2, the shield plate 15 is spaced from the top end of the hollow dome 10 and extends downwardly and arcuately outwards to terminate at a lower edge 52 directed outwardly of the cylindrical sleeve 40 to direct rain water, snow or any other matter falling through the slot opening 14 and impinging on it, outwardly thereof. The side edges 53 of the shield plate 15 are outwardly turned whereby the plate acts as a channel. Also, this outward turned edge streamlines the upward draft from underneath the shield plate to provide for better evacuation of combustible products.

As shown in FIG. 1, the rear body portion 13 is provided with one or more vent apertures 54 in a lower portion thereof to regulate the suction force in the dome body created by strong winds impinging on the ventilating cap. As is also shown in FIG. 1, the governor plate 16 is secured to the rear body portion 13 by L-shaped brackets 55. The plate 16 may have any convenient shape and be of sufficient size to be able to stabilize the dome forward body portion 12 directly against the direction of the wind.

Another purpose of the arcuate shield plate 15 is to dampen the emission of sparks rising through the chimney. The ventilating cap 10 and shield plate 15 are constructed of light guage galvanized steel. The bearing element 25 is also constructed to steel and the bushings may be constructed of brass or steel. Any other suitable material that will withstand the thermal conditions of the chimney cap may be used.

It is within the ambit of the present invention to cover any obvious modifications thereof, provided such modifications fall within the scope of the appended claims.

I claim:

1. A chimney ventilating cap for the evacuation of combustion gas from chimneys, said cap comprising a spherical hollow dome body defined by a forward and a rear partly semi-spherical body portion, said front and rear body portions being secured together in a spaced-apart manner to define an opening between their circumferential edge, shield means associated with said opening, wind governor means secured to said rear body portion, said hollow dome body having a vertical pivot connection secured to an open-ended attachment base whereby said dome body is pivotal on said vertical pivot connection to rotate on said base.

2. A cap as claimed in claim 1 wherein said front and rear body portions are secured together through said vertical pivot connection, a bearing element in a top part of said pivot connection, said body portions being rotatable on said bearing element.

3. A cap as claimed in claim 2 wherein said vertical pivot connection comprises a rigid straight rod immovably secured at a bottom end to said attachment base, an elongated cylindrical sleeve positioned in spaced relationship about said rod, a top end of said sleeve being secured to said bearing element, said bearing element being pivotal on a top end of said rod, and a bottom cylindrical sleeve secured to a lower edge of said body portions and attached to a lower portion of said elongated sleeve.

4. A cap as claimed in claim 3 wherein said bearing element has a lower pivot post portion having a concave end face to rest against a ball bearing, said top end of said rod having an annular ring portion with a bushing therein to receive and retain said ball bearing and a portion of said lower pivot post portion, said bearing element further having a shoulder portion to which said elongated cylindrical sleeve is secured and held concentric with said rod, a connecting plate secured to said bearing element and a top portion of said body portions and extending over a top portion of said opening, and fastening means removably securable to a top portion of said bearing element.

5. A cap as claimed in claim 3 wherein said bearing element is self-lubricating, a lubricant reservoir attachable to a top part of said bearing element, and a lubricating channel extending vertically through said bearing element from said reservoir to said concave end face.

6. A cap as claimed in claim 3 wherein said attachment base comprises a cylindrical connecting sleeve to attach said cap to a chimney, support ribs secured inwardly across said connecting sleeve, said rod bottom end being secured to said ribs, said bottom cylindrical sleeve secured to a lower edge of said body portions being attached to said lower portion of said elongated cylindrical sleeve by further support ribs secured to a sleeve bushing secured about said lower portion of said elongated cylindrical sleeve.

7. A cap as claimed in claim 1 wherein said shield means is a stationary arcuate shield plate secured inwardly of said dome body and spaced adjacent said opening.

8. A cap as claimed in claim 7 wherein said opening is a slot opening, a connecting plate secured to a top portion of said body portion and secured to a top portion of said vertical pivot connection and extending over a top portion of said slot opening, a bottom cylindrical sleeve secured to a lower edge of said body portions and extending about said open ended attachment base, said arcuate shield plate having a lower edge directed outwardly of said bottom cylindrical sleeve to direct rain water, snow or other foreign material on said shield plate outwardly of said cylindrical sleeve.

9. A cap as claimed in claim 1 wherein said rear body portion is provided with one or more vent apertures in a lower portion thereof to regulate the suction force created by strong winds impinging on said cap.

10. A cap as claimed in claim 1 wherein said wind governor means is a vertical plate secured to said rear body portion and extending in a plane passing through the central vertical axis of said dome body and the foremost apex of said forward body portion from said vertical axis whereby said forward body portion will be directed against the direction of the wind to induce the maximum suction force at said opening with said rear body portion facing downstream of said wind direction to prevent turbulence and thereby quickly evacuating combustion gas flowing out of said opening.

* * * * *